US005081819A

United States Patent [19]

Cloud

[11] Patent Number: 5,081,819

[45] Date of Patent: Jan. 21, 1992

[54] METHOD AND APPARATUS FOR MANUFACTURE AND PACKAGING OF FILTER PACKS FOR USE IN A BREW BASKET

[75] Inventor: Charles E. Cloud, Northbrook, Ill.

[73] Assignee: Cloud Corporation, Des Plaines, Ill.

[21] Appl. No.: 445,458

[22] Filed: Dec. 4, 1989

[51] Int. Cl.[5] ..... B65B 47/04; B65B 47/10

[52] U.S. Cl. ..... 53/453; 53/559; 53/579; 53/141; 425/373; 425/388

[58] Field of Search ..... 53/453, 141, 372, 454, 53/579, 559, 560; 141/144, 163, 265, 270, 280; 425/373, 388

[56] References Cited

U.S. PATENT DOCUMENTS

| | | | |
|---|---|---|---|
| 2,033,201 | 3/1936 | Chesney | 53/141 |
| 3,038,282 | 6/1962 | Hansen et al. | 53/560 X |
| 3,184,895 | 5/1965 | O'Connor | 53/559 X |
| 3,192,684 | 7/1965 | Iannucci | 53/579 X |
| 3,218,776 | 11/1965 | Cloud | 53/559 X |
| 3,353,329 | 11/1967 | Cloud et al. | 53/559 X |
| 3,759,011 | 9/1973 | Akke | 53/559 |
| 4,375,146 | 3/1983 | Chung | 53/559 X |
| 4,571,924 | 2/1986 | Bahrani | 53/559 X |
| 4,747,250 | 5/1988 | Rossi | 53/559 X |
| 4,874,456 | 10/1989 | Takagi | 53/559 X |

FOREIGN PATENT DOCUMENTS

| | | | |
|---|---|---|---|
| 1247276 | 10/1960 | France | 53/559 |

*Primary Examiner*—John Sipos

*Assistant Examiner*—Beth Bianca

*Attorney, Agent, or Firm*—Charles F. Meroni, Jr.

[57] ABSTRACT

A packaging machine and a method for continuous forming of filled packages from relatively unstretchable roll stock of crinkled heat sealable filter paper. A series of pouch forming drum sockets are provided in an outer surface of a revolving drum and the paper is trained on the drum over the sockets. Another mechanism is provided for slitting the sheet of the filter paper along its length creating a pair of side-by-side heat sealable filter paper strips before the paper reaches the drum. A driven endless flexible before the paper reaches the drum. A driven endless flexible belt is operatively engaged with the outer drum surface. A suction device is provided for drawing overlapped belt areas of the belt into the drum sockets along with the relatively unstretchable crinkled filter paper strips sandwiched between the overlapped belt area and the pouch forming drum sockets thereby forming side-by-side continuous strips of crinkled filter paper pockets. An apparatus is provided for filling the crinkled filter paper pockets with material to be packaged while on the drum. A further apparatus is provided for training and overlapping a second sheet of heat sealable filter paper over the filled paper sockets on the pair of side-by-side paper strips. A heat sealer is provided for sealing the overlapped heat sealable sheets of filter paper in sealed connection about the filled paper sockets to form sealed filled pouches and a cutter cuts them apart and they are deposited on a conveyor.

20 Claims, 10 Drawing Sheets

METHOD AND APPARATUS FOR MANUFACTURE AND PACKAGING OF FILTER PACKS FOR USE IN A BREW BASKET

BACKGROUND OF THE INVENTION

In the past, where coffee makers have made coffee in various types of contemporary type coffee makers, it has been the practice for the maker to put a paper filter into the coffee brewing section of the coffee maker, and then to put a measured amount of coffee on top of the filter paper. Some types of machines have a separate water receiving chamber where a predetermined number of cups of water are placed. In the water receiving chamber, the water is heated and caused to flow into the coffee brewing section of the coffee maker where the filter and the coffee is located so that coffee can be brewed and the brewed coffee can flow through the filter into a coffee receiving receptacle.

In order to speed up coffee making procedures and also to be sure that a correct predetermined amount of coffee is placed into the coffee brewing section of the coffee maker, and in accordance with my invention, I have developed a new and improved method and apparatus for manufacture of prefilled coffee pouches or filter packs which are shaped and designed so that a coffee maker can remove the preformed coffee filled pouches or packs from a coffee can or container and place them on a one-by-one basis directly into the coffee brewing section of the coffee making machine without any need for the more time consuming less accurate two step procedure that has been required in the past as described above.

In accordance with my invention, I have found that my method and apparatus operate most desirably with a so-called crinkle type heat sealable filter paper of a relatively nonstrechable type. It has been found that excellent results can be obtained where the filter paper is manufactured of a material composition that includes polypropylene pulp and natural fibers which are otherwise identifiable in the trade as Dexter Grade 9926 which is one preferred embodiment. When using filter paper of this type for the purpose of forming pouches that can be filled with coffee, I have after through a considerable amount of experimentation that excellent results can be attained in producing the filled pouches or packs as a result of practicing my new method and by using my new apparatus.

SUMMARY OF INVENTION

In a packaging machine for continuous forming of filled packages from relatively unstretchable roll stock of crinkled heat sealable filter paper, the improvement of a driven revolving drum attached to the machine, a series of pouch forming drum sockets provided in an outer surface of the drum, means for training roll stock paper onto drum over sockets, means for slitting the sheet of the filter paper along its length creating a pair of side-by-side heat sealable filter paper strips before the filter paper reaches the drum, a driven endless flexible belt operatively engaged with the outer drum surface, suction means for drawing overlapped belt areas of the belt into the drum sockets along with the relatively unstretchable crinkled filter paper strips sandwiched between the overlapped belt area and the pouch forming drum sockets thereby forming side-by-side continuous strips of crinkled paper pockets, means for filling the crinkled filter paper pockets with material to be packaged while on the drum, means for training and overlapping a second sheet of heat sealable paper over the filled filter paper sockets on the pair of side-by-side filter paper strips, means for sealing the overlapped heat sealable sheet of filter paper in sealed connection about the filled paper sockets on the pair of heat sealable filter paper strips to form sealed filled pouches, conveyor means for transporting sealed filled pouches after being severed from the lapped sealed strips of filter paper, and means for severing the filled pouches from the overlapped sealed strips and depositing the severed filled pouches upon the conveyor means.

According to other features of my invention, I have developed a new and improved method for forming product filled individual packages. The method comprises the steps of moving a first continuous length of crinkle type heat sealable filter paper of a relatively nonstretchable type towards a forming area, simultaneously training a stretchable flexible rubber-like belt in contact with the filter paper with the filter paper being between the belt and the forming area, consecutively suction drawing spaced areas of both the filter paper and the rubber-like belt into pouch forming sockets for forming side-by-side pouches from the crinkle type heat sealable filter paper spaced along the first continuous length of the paper, releasing the suction allowing the stretched areas of the belt to move out of the pockets, filling the pouches with product, causing a second length of paper of heat sealable paper to be superimposed against the first length of paper together, sealing the superimposed length of paper together forming filled sealed pouch areas, and cutting out the sealed pouches from the sealed first and second lengths of filter paper to form individual product filled packages.

Yet other features of my invention concern a method of forming product filled individual packages comprising the steps of moving a first continuous length of crinkle type heat sealable filter paper of a relatively nonstretchable type towards a forming area, slitting the paper into side-by-side slit strips, consecutively drawing spaced areas of the slit strips into pouch forming sockets for forming side-by-side pouches from the crinkle type heat sealable filter paper spaced along the length of the slit strips, filling the pouches with product, causing a second length of paper of heat sealable paper to be placed against the first length of paper, sealing together the second length of paper to the strips together forming filled sealed pouch areas, and cutting out the sealed pouches from the sealed first and second lengths of filter paper to form individual product filled packages.

Still other features of my invention concern a new and improved filling wheel which has been provided for my packaging machine so that prescribed amounts of product can be conveniently dispensed on a sequential basis into the pouches formed on the continuous length of crinkle type heat sealable paper.

BRIEF DESCRIPTION OF THE DRAWINGS

Other objects and features of the present invention will become more fully apparent in view of the following detailed description taken in conjunction with the accompanying drawings illustrating several preferred embodiments, as follows.

DESCRIPTION OF THE PREFERRED EMBODIMENTS

Figure 1:
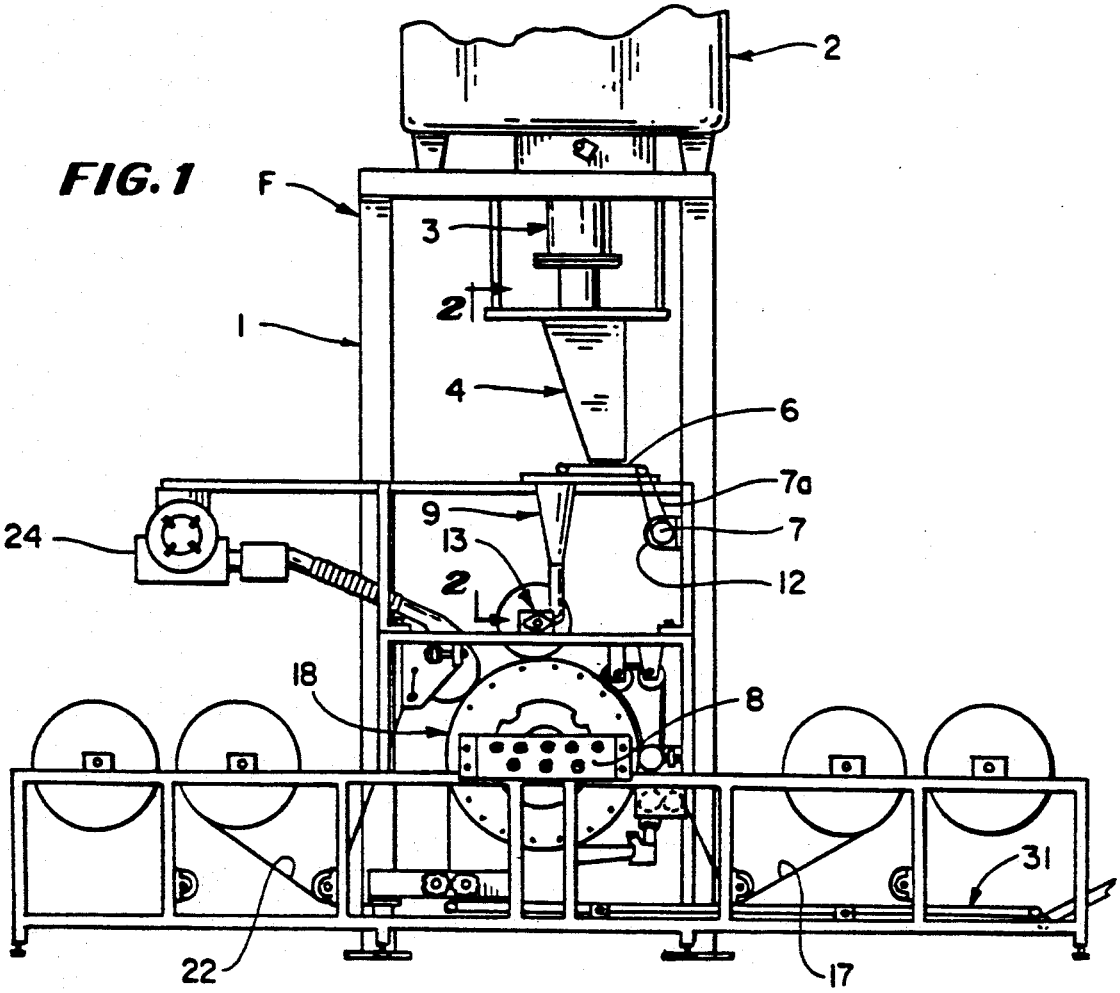
FIG. 1 is a fragmentary side elevation of my packaging machine.

The reference numeral 1 identifies my machine. We shall initially describe the broader operational features and will thereafter be more specifically described concerning certain more specific supporting features. My machine 1 is adapted to manufacture filter packs 10 (FIG. 14) and includes an overhead main hopper 2 that can be located at a top edge of frame F such as about fifteen feet above my coffee filter manufacturing machine. Downwardly extending bins 3 and 4 are provided beneath the main hopper 2 and receive coffee C therein. While my invention has been described for the manufacturer of coffee filled filter packs 10, the packs 10 can be filled with other beverages or foods such as hot chocolate or tea and the like.

Figure 2:
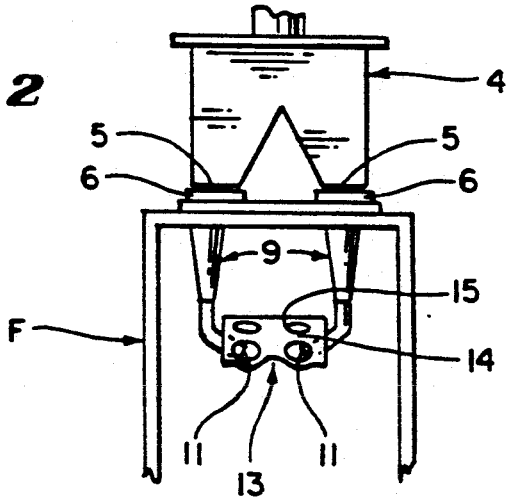
FIG. 2 is an enlarged fragmentary end view of the filling apparatus of my packaging machine.
Figure 3:
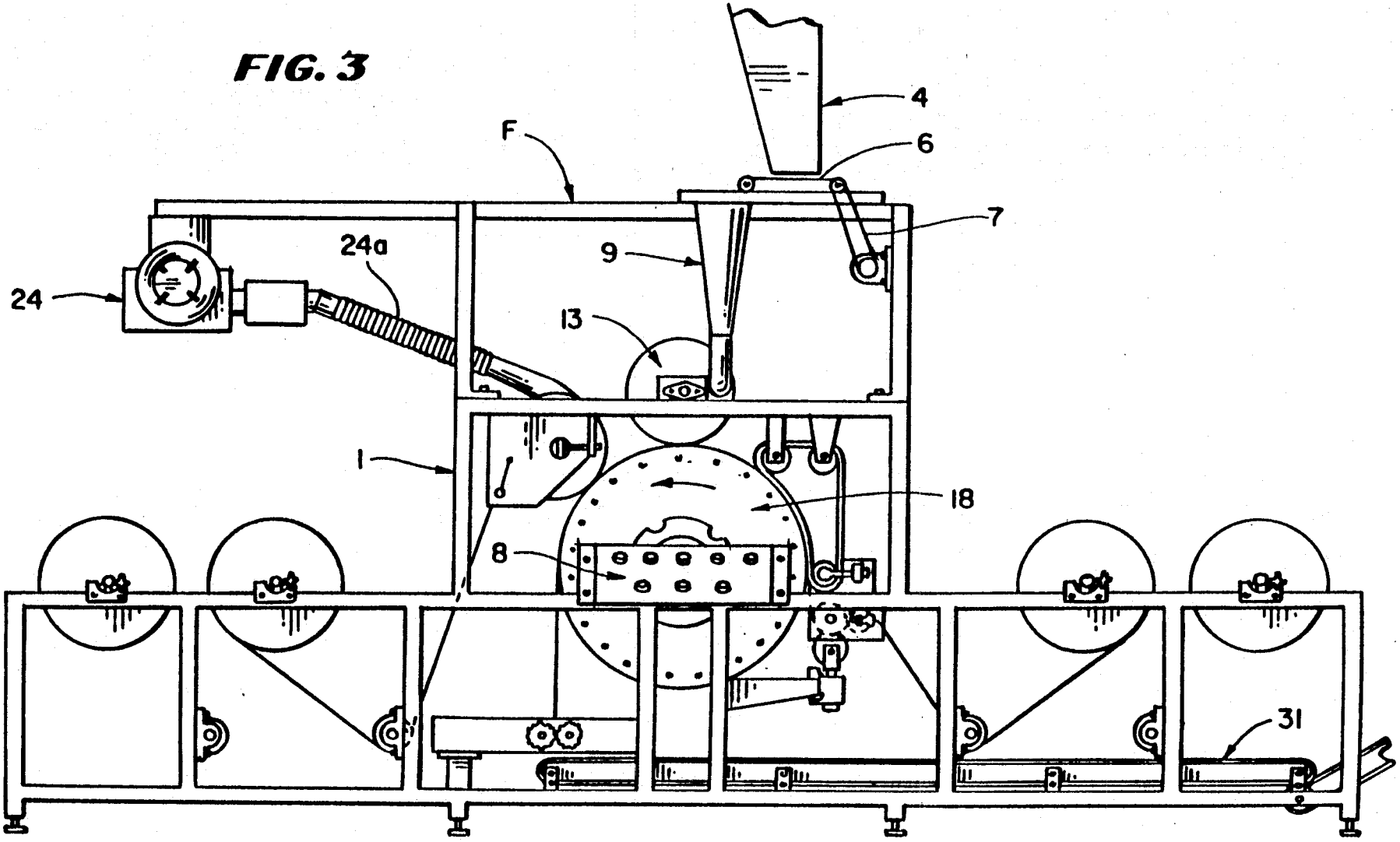
FIG. 3 is an enlarged fragmentary side elevation of the packaging machine shown in FIG. 1.

The coffee C (FIG. 6) is then transmitted from hopper 2 through a connected series of the bins 3 and 4. The bin 4 has dual side-by-side outlets 5,5. The bin outlets 5,5 function to deliver coffee C to a pair of side-by-side mounted dual conveyors 6,6. The conveyors 6,6 are driven by identical belt driven drives 7,7 all as seen in FIG. 1. A control panel 8 is provided for regulating the operation of the conveyors. The conveyors each are connected to a speed control on the control panel 8 so that the operator can individually speed up or slow down the running speed of the conveyor so that the amount of coffee C can be regulated as it is being moved from the bin 4 through the dual outlets 5,5 and then from the dual conveyors 6,6 to dual chutes 9,9. The dual chutes 9,9 are provided with dual discharge orifices 11 11 for discharge into the interior of a circular filling wheel 13 as seen in FIG. 2.

Summarizing, it will be appreciated that dual drives 7,7 each include a direct current drive motor 12 for operating a belt drive 7*a*. Each conveyor 6 has its own direct drive and a special variable speed control is operated from the control panel 8 for regulating the drive. The coffee or other food is conveyed to the conveyor and the quantity of the coffee unloaded on the conveyor can be regulated and where it is desired that a greater amount of coffee be delivered to the circular filling wheel the drive can be run faster and where a smaller amount of food is desired then the conveyor speed can be decreased. It is in this way that the amount of coffee delivered to the filling wheel 13 can be regulated. These arrangements for supplying the filling wheel with product can be varied as may be required.

Figure 4:
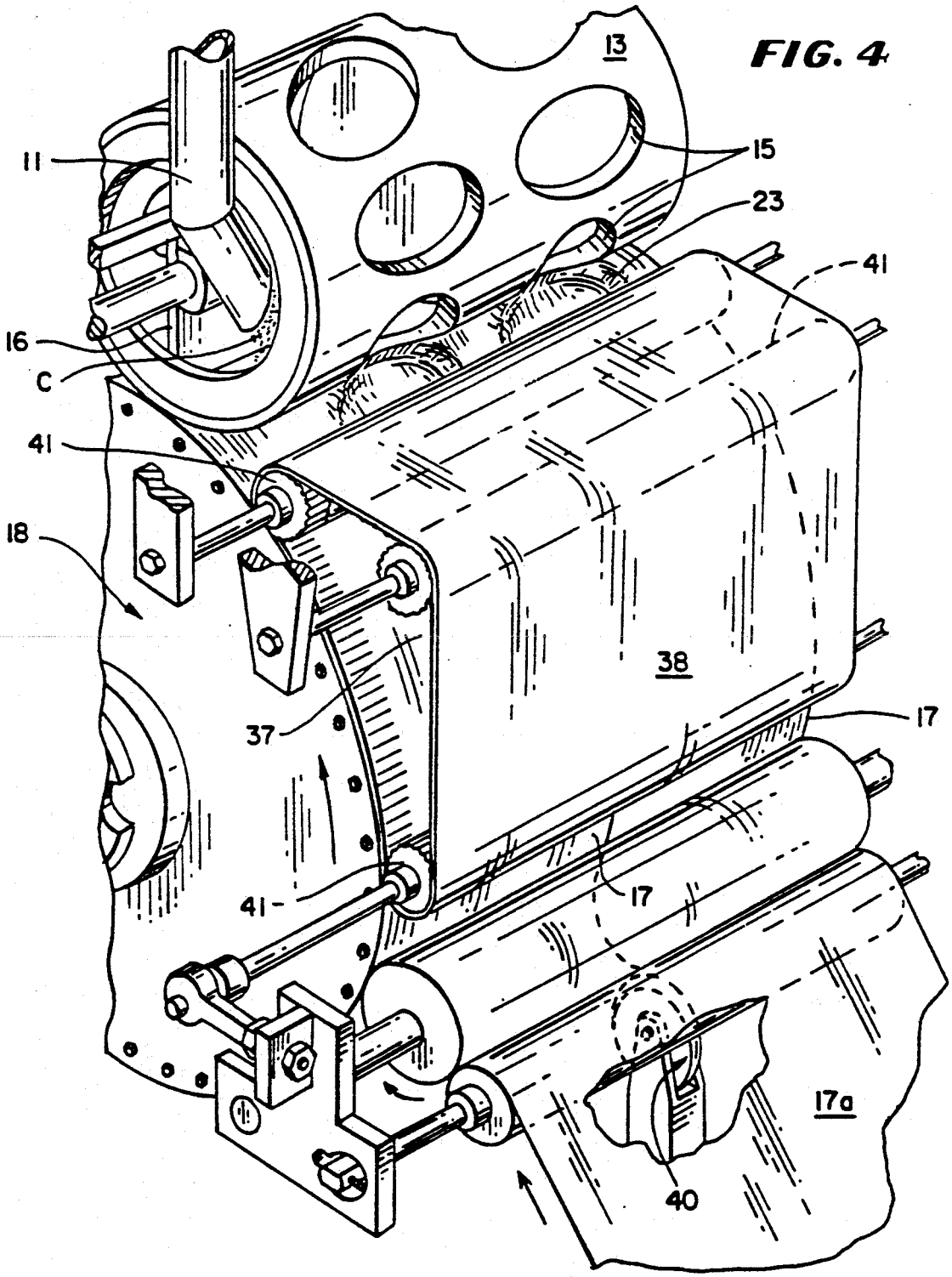
FIG. 4 is an enlarged fragmentary perspective view of a package forming section of my packaging machine.
Figure 5:
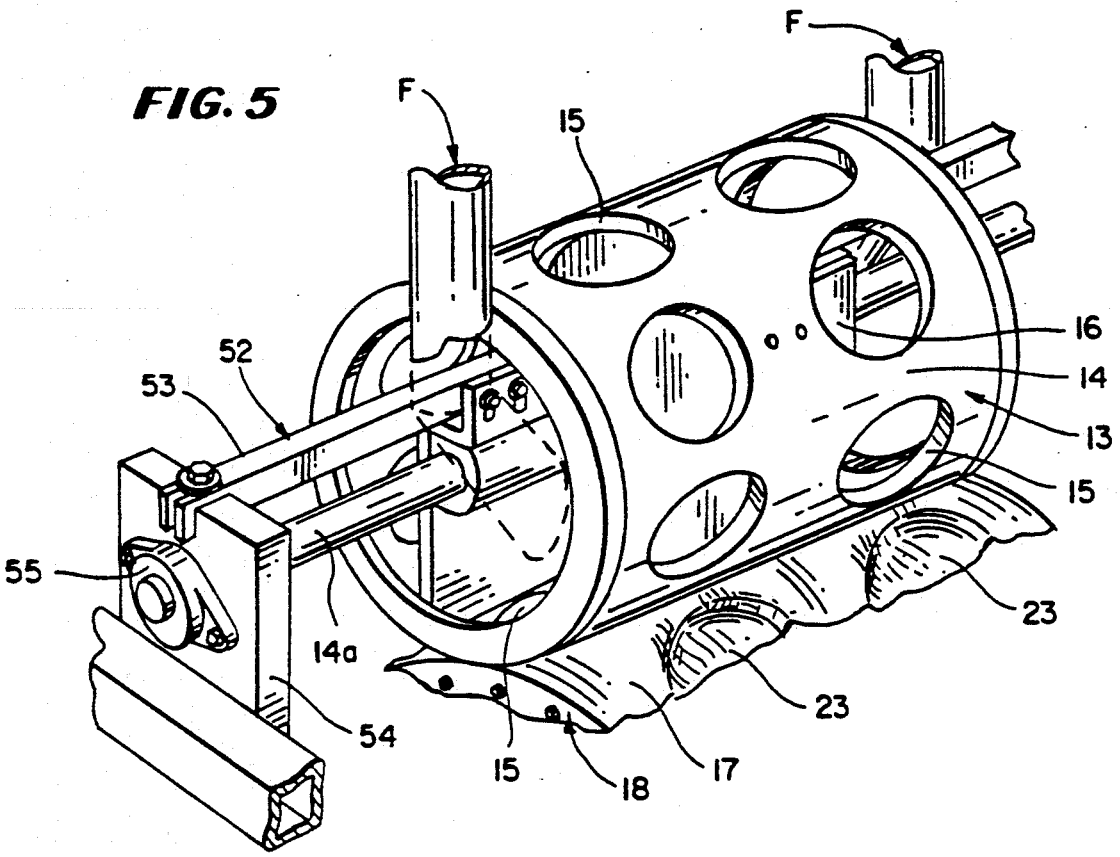
FIG. 5 is an enlarged perspective view of a pair of driven drums that are used in the formation and filling of filter paper pouches from continuous strips of material.
Figure 6:
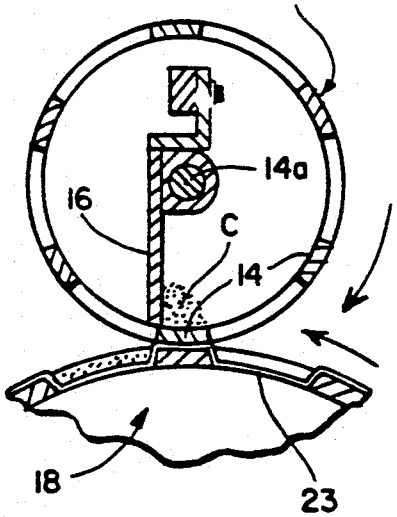
FIG. 6 is an enlarged fragmentary vertical section showing the way in which the formed pouches are filled using the apparatus shown in FIG. 5.

The filling wheel 13 is driven so as to rotate in a clockwise direction. The wheel 13 has land areas 14 provided with circumferentially spaced rows of wheel chutes or slots 15 (FIG. 4, 5 and 6). Each wheel chute or slot 15 is adapted to deliver or gravity feed a measured predetermined amount of coffee C to a radially aligned web pocket 23 to be filled as hereafter discussed.

Figure 7:
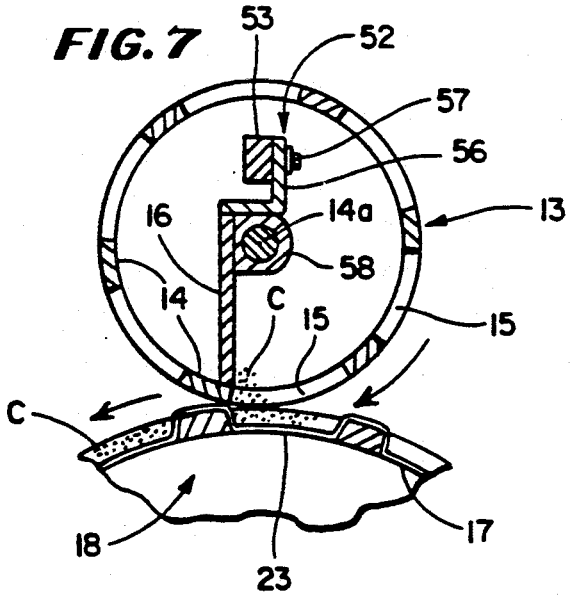
FIG. 7 is a vertical section similar to FIG. 6 only showing the drum in different positions than shown in FIG. 6.
Figure 8:
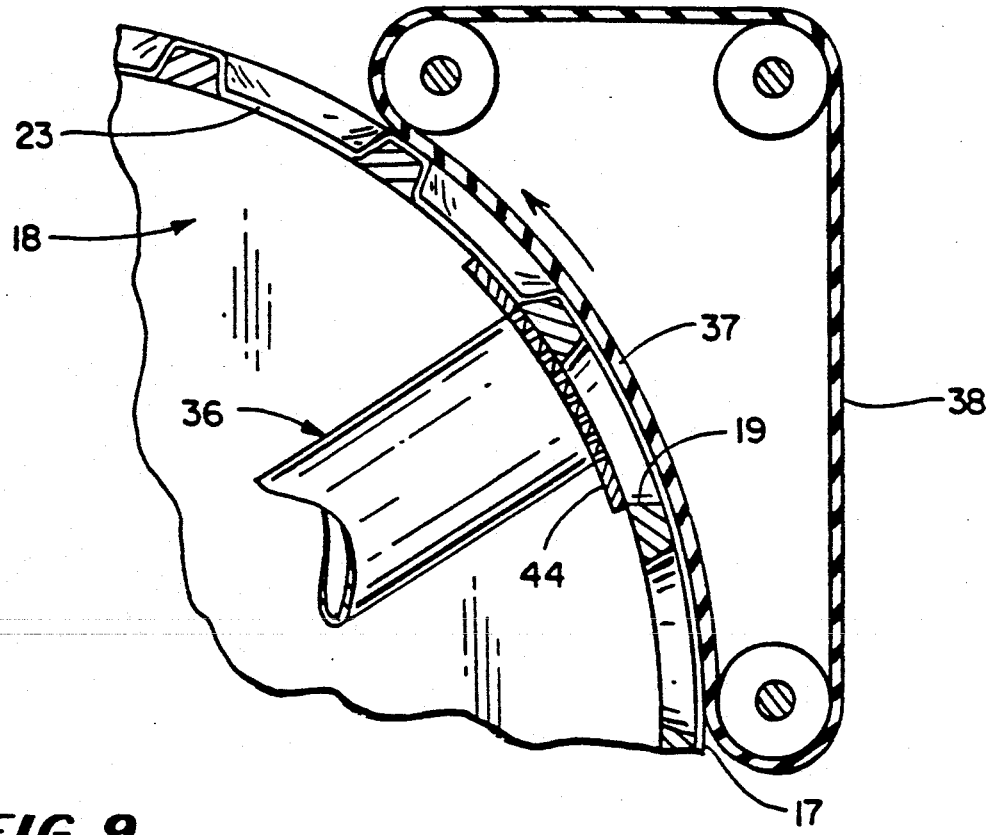
FIG. 8 is an enlarged fragmentary vertical section showing how crinkled filter paper can be applied to a forming section of my machine at a point just before suction is applied to draw the crinkled filter paper into pouch forming sockets.

There is a stationary scraper 16 positioned interiorally of the circular filling wheel 13 and mounted on filling wheel drive shaft 14*a* (14*a*). The scraper 16 cofunctions with wheel 13 and the chutes or slots 15 so as to operate to insure that only a predetermined volumetric amount of coffee C will ultimately be received into the web pouches 23. After the top or radially inner edge of the chutes or slots 15 or land areas 14 between the chutes or slots 15 are scraped, the coffee C is then allowed to be unloaded or scraped from the land areas and gravity fed into the pouches 23 formed in the continuously moving coffee paper web 17 as just described above. The filling wheel 13 is driven relative to the stationary scraper 16 to cause the wheel chutes or slots 15 to be emptied by the force of gravity as the filling wheel and the scraper causes the coffee C on the lands 14 to fall through the chutes or slots 15 in the filling wheel 13 into the pouches in radial underlying alignment therewith. The pouch filling operation occurs at an approximate 6 o'clock position on the filling wheel (FIGS. 6 and 7).

The continuous coffee paper webs 17,17 are trained from a roll of relatively unstretchable filter paper or paper stock 20 beneath and over a pair of guide rollers 21 and then about an underlying larger drum 18. The drum 18 has suction applied interiorally of it for sucking the paper webs 17,17 at predetermined intervals, into rows of drum pockets 19 that are provided. The filling wheel 13 is caused to unload its contents on the underlying moving web of paper 17 that has deep paper pockets 19 in it. Before unslit web 17*a* is formed with the pockets 19, a paper slitter 40 (FIG. 4) can be employed to slit the web 17*a* in half forming the side-by-side webs 17,17 to facilitate the formation of the deep paper pockets 19 as will be further discussed hereafter.

Figure 12:
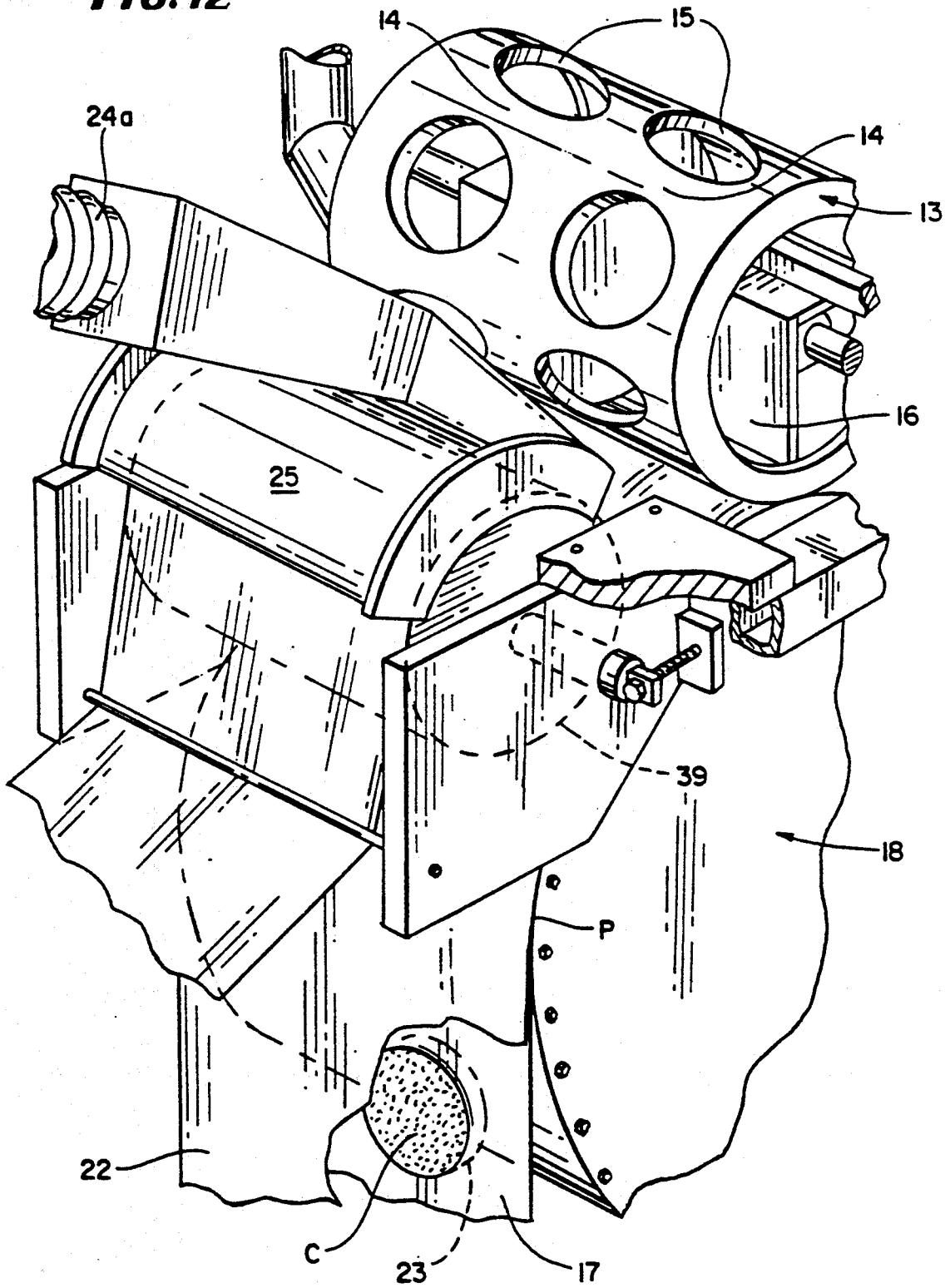
FIG. 12 is an enlarged fragmentary perspective view showing the way in which the machine and its components co-act so that heat can be applied to a second strip of heat sealable paper at or about the time when this paper is engaged against the strips having the formed pouches to seal open ends of the pouches.

Thereafter at a position of approximately 11 o'clock, a second web of material 22 is fed onto the big wheel or drum 18 by web training or guide rollers 21—21 in overlying abutment with the underlying moving slit webs 17,17 of coffee filled pockets 19 to provide closed or heat sealed filled pouches 10. An air blower and heater assembly 24 is provided having hoses on air line 24*a* with a hooded outlet 25 (FIG. 12) in the general vicinity of the area where the two bottom and upper webs 17,17 and 22 come together to cause the webs to then be heat sealed and assembled together and in this manner sealing the C coffee in closed or heat sealed pockets. The air blower and heater assembly 24, and the hooded outlet 25 co-act so that heat can be applied to the upper web 22. When this upper web 22 is heated and then applied to the lower web, the webs then are heat sealed together. I have found that it is more desirable only to apply the heat to the upper web 22 to avoid heating the coffee so that the coffee will not be blown around and out of the coffee filled pouches 23 thereby preventing the coffee from interfering with the sealing of the webs as the webs are being pressed together between drum 18 and roller 39 (FIG. 12).

Figure 13:
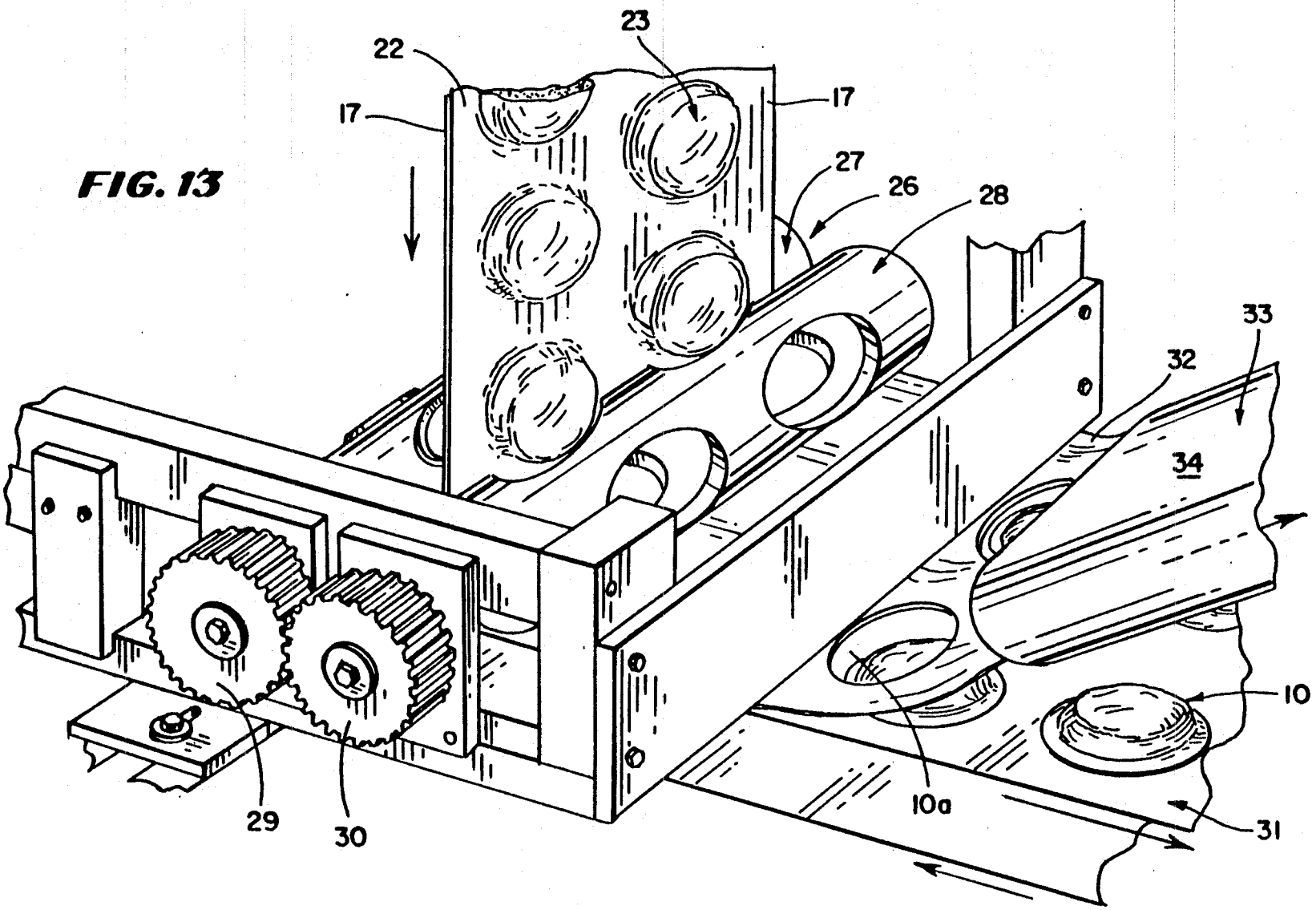
FIG. 13 is an enlarged fragmentary perspective view showing the continuous length of formed pouches moving through a mechanism for cutting out the formed and filled pouches and unloading them onto an underlying conveyor.
Figure 14:
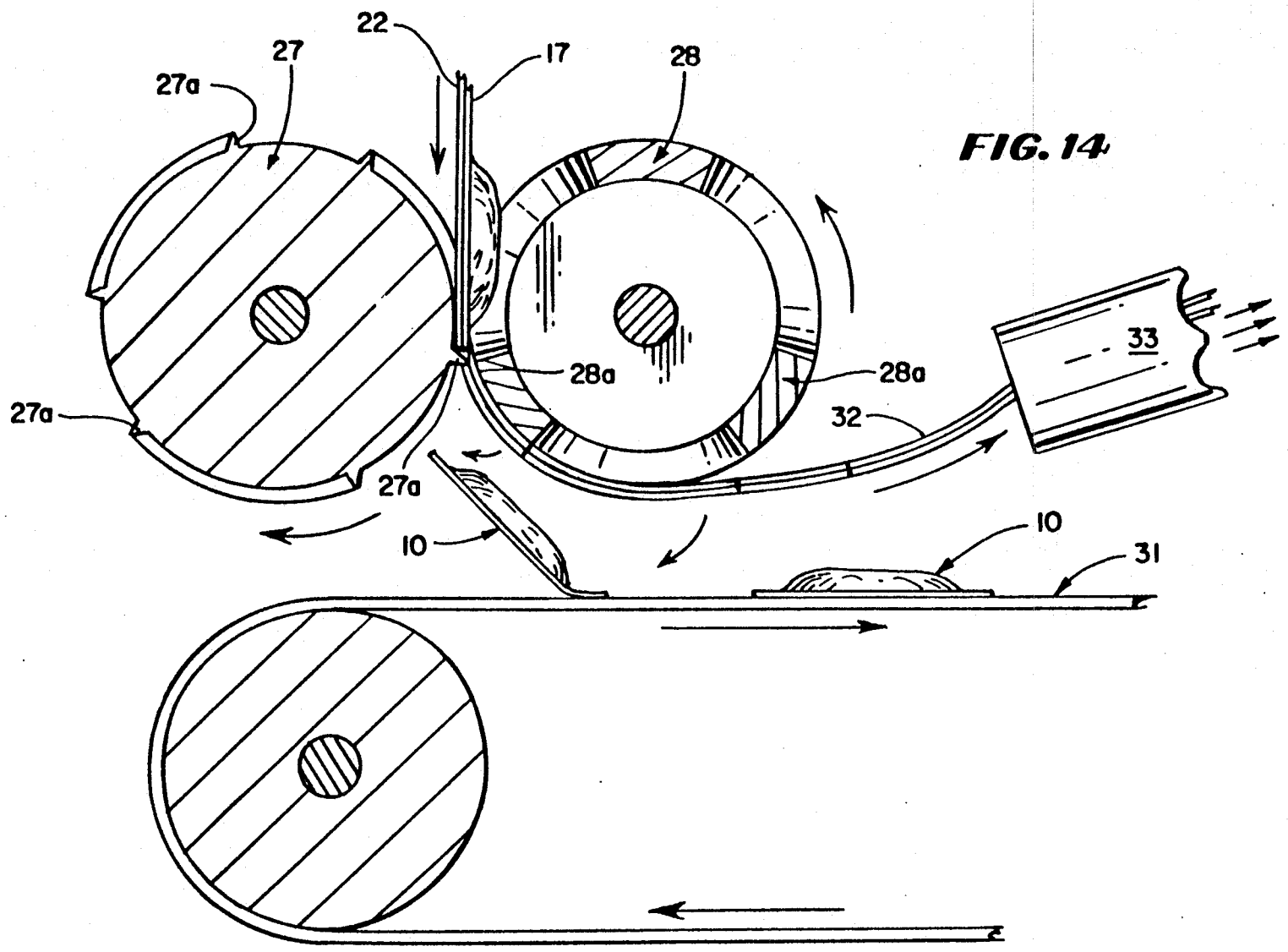
FIG. 14 is an enlarged fragmentary vertical section of the apparatus shown in FIG. 13 diagrammatically illustrating the way the formed, filled pouches are severed from the continuous lengths of heat sealable crinkle type paper and then dropped onto an underlying conveyor.

Both webs 17,17 and 22 are of the same composition of material. As the drum 18 rotates and moves counter clockwise from the 11:00 o'clock position, the sealed webs 17 and 22 carrying the heat sealed filled pouches 10 are trained downwardly at right angles to a horizontal radius or point P of the wheel and they are caused to go into a cutting station 26 which has circular die cutters or cookie-type cutters 27 and 28 (FIG. 13). As these circular die cutters 27, 28 are rotationally driven through meshed gears 29 and 30, each side-by-side pair of cutters 27, 28 simultaneously cut out the circular filter packs 10 (FIG. 13) leaving web scraps 32. The cutters 27 include circumferentially spaced knives 27*a* and the cutters 28 are provided with circumferentially spaced lands 28*a*. The knives on the cutter 27 and the lands or anvils on the cutters 28 co-act when engaged together as shown in FIG. 14 to cut the webs 17,17 to cut out each of the coffee filter packs 10 as seen in FIG. 14. These filled filter packs 10 then are moved onto a conveyor 31 which takes them to a coffee can filling station (not shown) where the cans are filled with a pre-selected number of the filled filter packs 10. Any suitable power source (not shown) can be connected to drive the meshed gears 29 and 30.

As the filter packs 10 are moved onto the underlying endless driven conveyor 31 (FIGS. 13 and 14), scrap 32 (FIG. 13) that has been cut from the webs 17 and 22 is drawn into a vacuum tube or suction device 34 which takes the scrap to a disposal location or dump. If any filter packs 10*a* remain unfilled, the suction device 34 also operates to pick up such empty filter pack 10*a* and transports them to the dump. Thus, the power of the vacuum in the suction device 34 is controlled so that it can remove empty filter packs and scrap but not filled filter packs 10.

A suction head 34 (FIG. 13) is positioned just downstream of the die cutter area or the cutting station 26. Excellent results can be attained where the drum pockets and the web pouches are each 4" in diameter and each have a depth of ⅝" at center. It is further noted that at the can or container filling station (not shown) that the so-called over wrap cans are in reality of a paper composition. The cans are called "Ceka" containers.

This packaging line also has other components in addition to those just described. As an example, the packaging line my include a can or carton machine for receipt of the filter packs produced my machine 1. Basically the "Ceka" (a trade name for a "Ceka" can for coffee and the like) line of equipment forms the containers, then the containers are moved along a conveyor and hand filled with a predetermined number of filter packs. Thereafter, the containers are moved on a conveyor into a gas chamber for substituting the atmosphere contained in the open ended containers whereby a nitrogen atmosphere is put into the containers. This gas flush system is not part of my development but it can be made part of the overall line of equipment used to produce sealed containers filled with my filled filter packs or packages 10. At one point gas filled coffee filled containers (not shown) can be then transported to another machine which puts lids onto the coffee containers. The lid assembly can be of a so-called double lid type. Initially, the first lid can be formed in the "Ceka" indexing lid forming section of the machine. The filled and sealed containers can be then transmitted to another station where the containers are provided with a lid which closes the partially open end of a container (not shown). The top or closing lid (not shown) is press fitted onto the open end of the container. Beneath the final lid is of course a pull away lid that a consumer breaks to gain access to the contents of the container. Once the interior lid is broken, the exterior lid can then be used to provide a temporary closure for the container so that the coffee can be kept as fresh as possible.

It is well known that coffee must be packaged in an oxygen free or air free atmosphere in order to preserve its freshness and shelf life and the line of equipment is preferably built to accomplish this result. After the containers have been provided with lids, they can then be transported to a cartoning section where a predetermined number of filled containers can be put into cartons and the cartons can then be sealed and ready for shipment.

It is contemplated that the manufacturing line can fill each carton with twelve (12) containers or "Ceka" cans with each having ten (10) pouches in the container. It is further contemplated that the containers will be processed so as to have a preselected atmosphere such as nitrogen therein to maintain the fresh character of the coffee.

Figure 10:
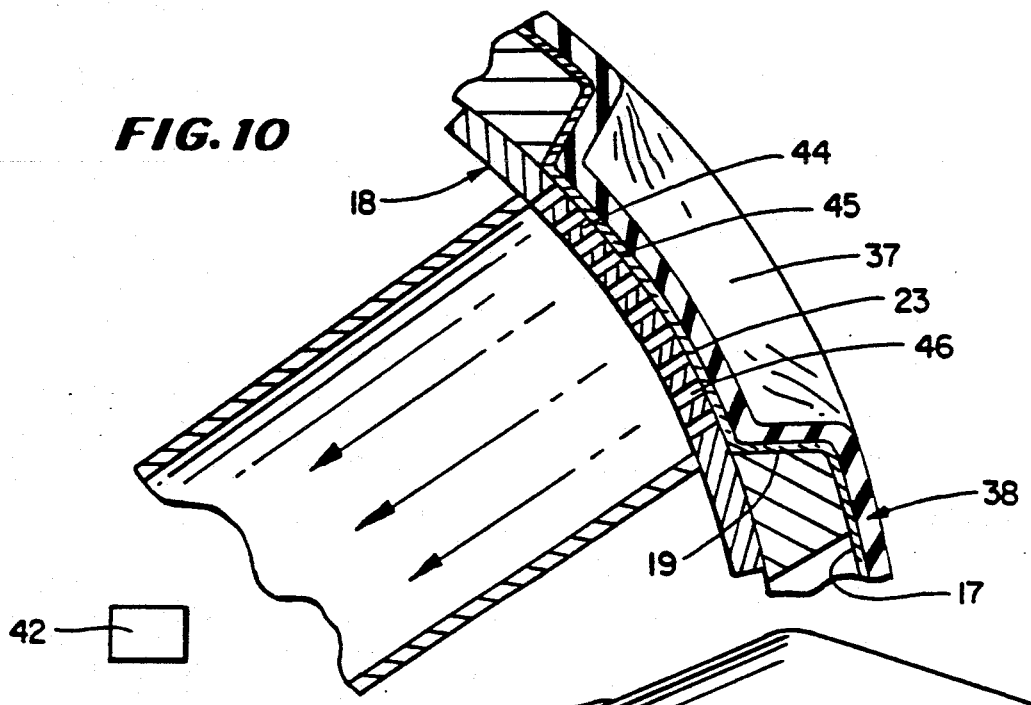
FIG. 10 is an enlarged fragmentary vertical section showing an enlargement of a portion of FIG. 9 and with the arrow indicating the direction of the suction force applied to the rubber belt for forming the paper and forcing the filter paper into the socket.

In accordance with other features of my invention the belt is an important element in connection with the formation of the pouches. The paper is placed up against the drum and then the belt is then placed on top of the paper and the two travel along the surfaces of the drum at the same point in time. A vacuum is drawn by a suction motor 42 through a suction head 36 (FIG. 10) forming the pouch and the vacuum being drawn through the paper and pulling the belt down provides a well formed pouch. The arrows 43 in FIG. 10 diagrammatically show the way in which the suction acts against the impervious rubber belt segment 37 to draw it and the web paper 17 into the drum cavity 19. The drum cavity 19 has a perforated screen-like member 44 that provides a bottom surface 45 against which the belt segment 37 and the web paper 17 are drawn in the drum cavity 19, and the web paper 17 are drawing in the drum cavity 19. The suction can freely act through the performations 46 in screen-like member 44.

The pouch and the belt then separate and the filling step follows.

The rotary drum 18 has a female shape or drum cavity 19 cut into it to provide a female form. A flexible rubber belt 38 is positioned in intimate contact with the drum and the belt co-rotates with the drum. The web paper or film on the drum can be slit in half and one piece of paper 17a,17a is provided for each row on the drum 18. When the vacuum is turned on, since the web paper 17a,17a is porous the vacuum goes through the paper and it sucks the flexible rubber belt segment 37 into the cavity thus drawing the paper into the cavity. In my preferred form, the paper webs 17a,17a are "crinkled" and relatively non-stretchable but the "crinkles" can flatten a bit and the web can be drawn from paper areas surrounding where the suction is applied to the web paper 17a,17a to permit the crinkled non-stretchable filter paper to be reshaped inside the drum cavities to provide pouches of a predetermined circumference and depth so as to be capable of functioning as a beverage filter or a filled coffee filter pack 10.

The rubber belt 38 used to form the filter paper into the drum cavities is a 1/64" thick Buna-N commercial grade rubber. The rubber belt 38 can be cut from sheeting and its belt ends can be glued together to form an endless belt. On each edge of the rubber belt, a 1" wide timing belt (not shown) can be glued to carry the rubber sheeting continuously around timing belt pulleys 41 and in contact with the main drum 18.

The web 17a is slit so that the crinkled paper can be pulled from all sides of each of the drum cavities 19 as shown at 47,47 (FIG. 11) into the cavity 39 for forming each of the pouches 23 in the paper webs 17,17. If the web 17a were a solid piece from the center of the unslit web 17a with the film or paper trying to go both directions the paper web would have to be pulled from the outer edges to form the cavity or pouch 23.

Excellent results can be attained with the use of certain materials. The definitions of one preferred filter packaging material which we have found are: Dexter Grade 9926 Material Composition Polypropylene pulp and natural fibers, and Dexter Grade 9926 tentative specifications, material description. Grade 9926 is a two-phase, light weight permeable heat seal tissue comprised of thermoplastic fibers, abaca pulp and other selected cellulose fibers. It offers, high wet-strength, excellent taste neutrality, and features maximum extraction while exhibiting good particle rentention. All materials used to manufacture grade 9926 are certified to be in accordance with 21 CFR 176.170, components of paper and paperboard in contact with aqueous and fatty foods. The filter paper is approximately 3 mil thick (0.003" thick) and, the rolls are 11½" wide before it is slit on our machine to approximately 5¾" wide.

Excellent results can be secured where the paper used in the webs 17 and 22 is a manila hemp base material made from fibers from abaca which are a natural blend of material somewhat like a plant which has high stretch ratios and to that a polypropylene fiber has been added which reduces both stretch and gives the ability to heat seal the material to itself to form the filter packs 10. The material is a web that has been formed with a micro creep to give it between six and eight percent elongations so that it can be formed in a cavity on the forming side of the filling wheel 13 by the use of an apparatus 35 for forming the pouches 23 in the lower web 17.

Dexter Grade 9926 material include a composition of polypropylene pulp and natural fibers. The roll width may be 11.5", and the roll length may be 1,400 yards.

Figure 9:
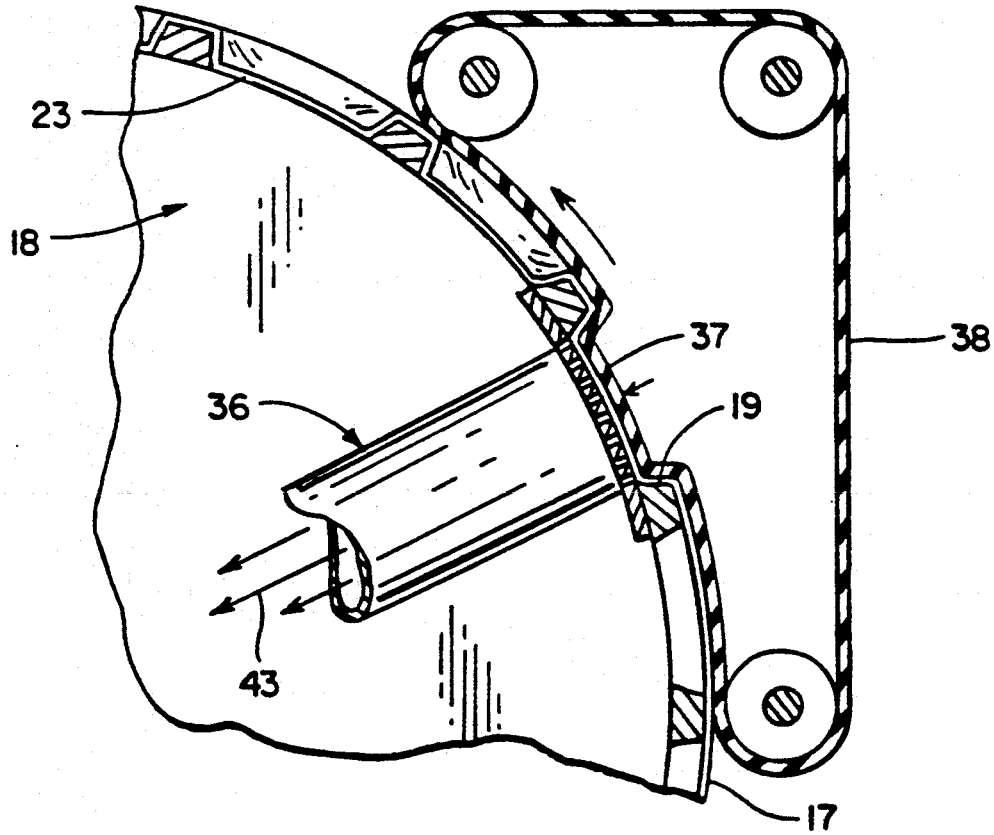
FIG. 9 is an enlarged fragmentary vertical section similar to FIG. 8 only showing the way in which suction can be used to form the crinkled filter paper by drawing the filter paper into the socket.
Figure 11:
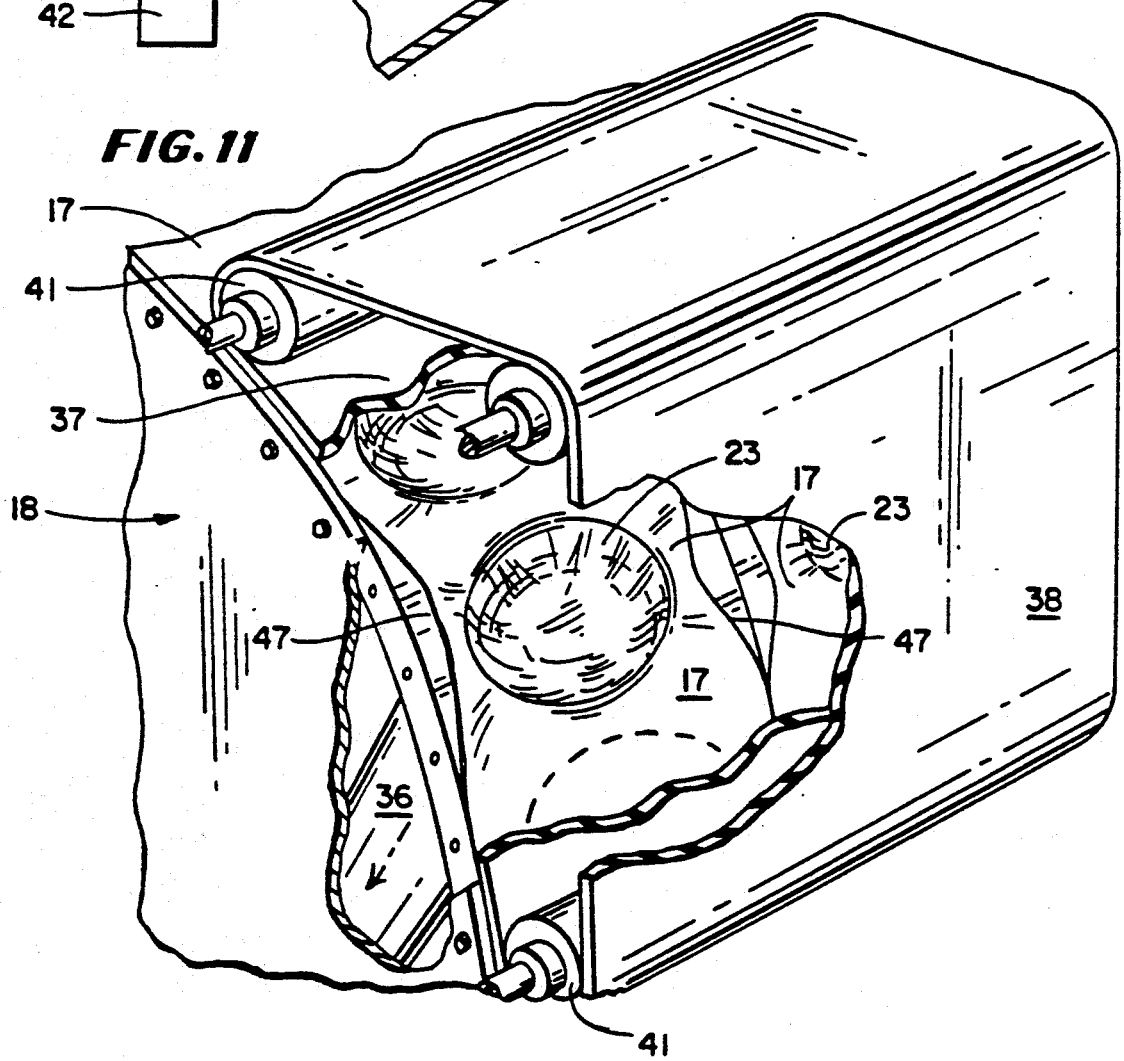
FIG. 11 is an enlarged fragmentary perspective view showing the way in which the rubber belt overlies the packaging material for assisting in the formation of pouches in the filter paper.
Figure 15:
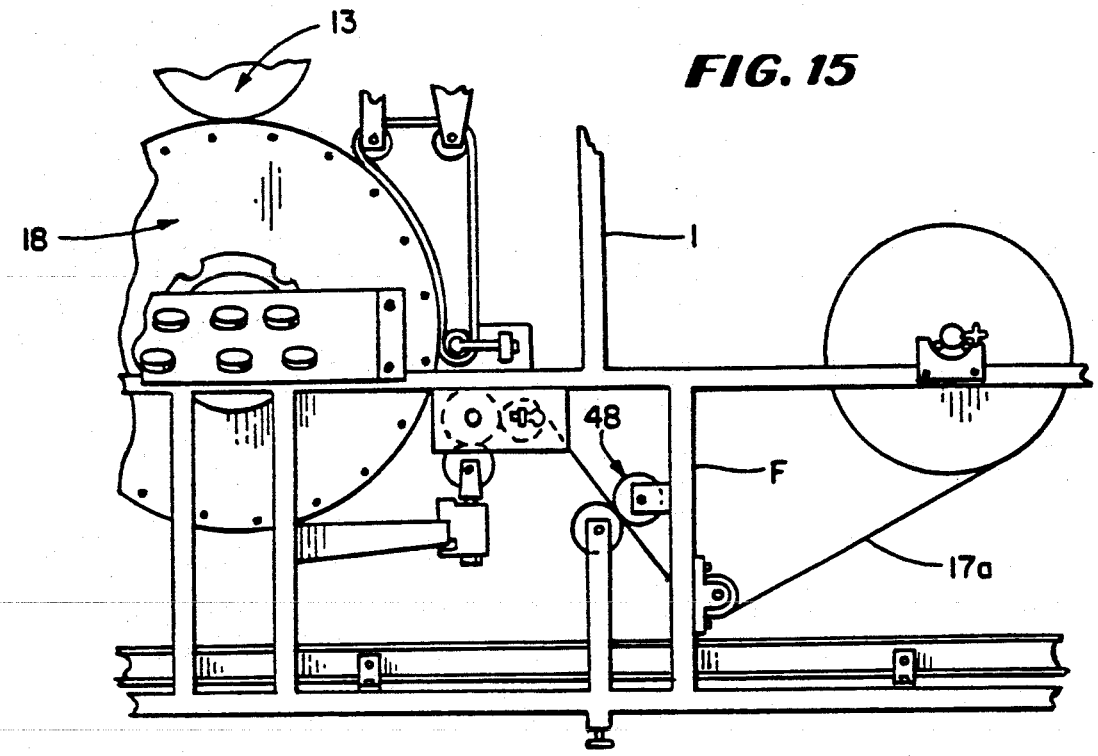
FIG. 15 is a fragmentary side view of a modified packaging machine for forming filled pouches from filter paper that is crinkled before it is formed into pouches.
Figure 16:
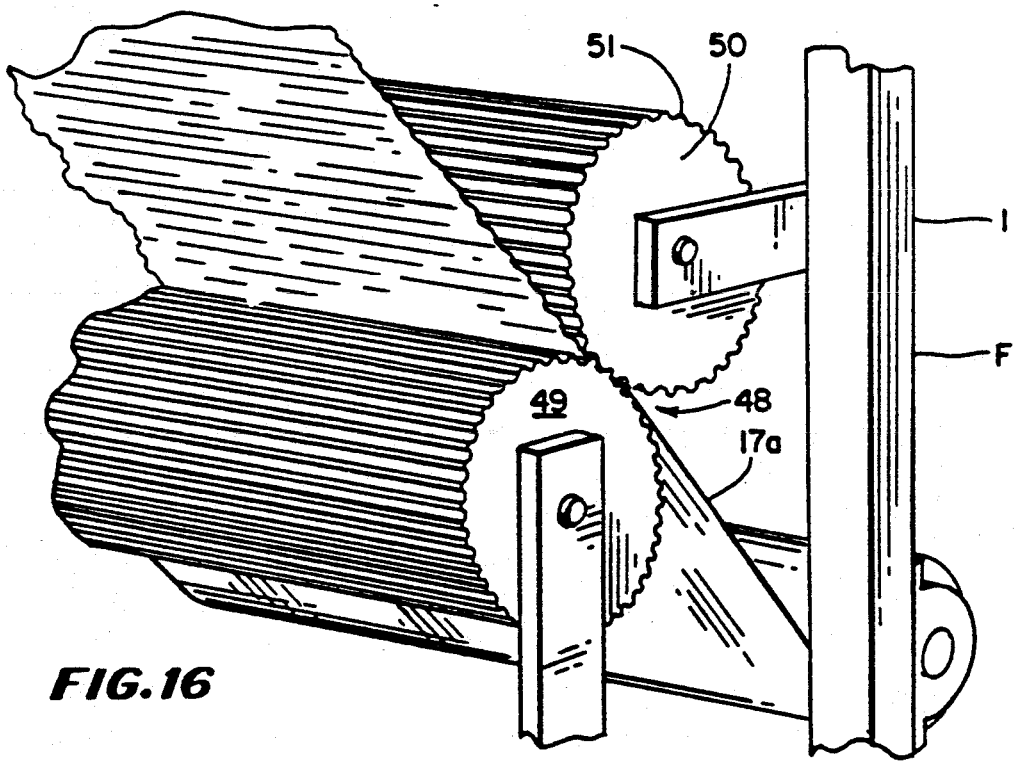
FIG. 16 is an enlarged fragmentary view showing the manner of forming the filter paper in a crinkled form.

In FIGS. 15 and 16, I have illustrated a modified machine 1. In these figures, I have illustrated the machine as being provided with an apparatus 48 including a pair of rollers 49 and 50 which rollers 49 and 50 are provided with circumferentially spaced paper forming ribs 51. As the web 17a is drawn through the machine 1, the web 17a passes between the rollers 49 and 50, and the ribs 51 on the rollers 49 and 50 serve to form so-called transverse "crinkles" in the paper. By using an apparatus of this type, uncrinkled paper can be converted into crinkled paper so that a relatively non-stretchable type of paper can be used in my machine 1 to form pouches 23 in the manner previously described and illustrated as shown in FIGS. 9, 10 and 11. In this respect, it will be seen how the ribs 51 on the respective rollers 49 and 50 can interact and mesh to form the transverse "crinkles" in the paper web 17a. Another pair of rollers can be provided to also form longitudinally extending ribs in the paper 17a, if desired.

In order to prevent the scraper 16 from rotating, a scraper lock out device 52 is provided as shown in FIGS. 6 and 7. To this end, the lock out device includes a bar 53 which extends parallel to the filling wheel drive shaft 14a. The bar 53 is fixedly mounted to a pair of mounting blocks 54 (FIG. 5) mounted at opposite ends of the filling wheel drive shaft 14a. The filling wheel drive shaft 14a has bearings indicated at 55 which are also mounted on the support blocks 54 at opposite ends as previously described. The bar 53 has an angle 56 that is secured by fasteners 57 to the bar. Another leg of the angle 56 is in turn attached to stationary shaft 58. The scraper 16 is mounted to the stationary shaft 58 in fixed or stationary assembly. By mounting the scraper 16 in the manner illustrated in FIGS. 5, 6 and 7, the scraper can be held in a fixed non-rotating position.

In summary, my machine and method can be used for producing filter packs 10 of coffee as disclosed herein. Although the machine 1 would probably work on other papers, my invention contemplates, in one form, that the paper is porous and it allows the suction head 36 to suck the air through the paper and pull the segment 37 of the driven rubber belt 38 down into the wheel cavity 19. Once the paper is formed and the vacuum is released, the air can pass through the porous paper (leaving it in the cavity 19) while the rubber belt segment 37 returns to its original unstretched position (FIG. 11). For the foregoing reasons my machine and method involve the use of filter or porous paper. It is further contemplated that my machine can also be used for forming non-porous paper.

Steps have been taken to eliminate dusting of the coffee on the lower film to insure that dusting will not occur in the sealed areas. To this end, the apparatus for causing the coffee to fall into the filling wheel pockets 23 operates so that the pocket diameter on the wheel 13 is smaller (½") than the diameter of the pouch 23 that is to be filled whereby coffee is piled up in the center of the drum 18 so that it can be caused to fall into a controlled manner into the pouch 23 with a minimum of dusting to the paper area surrounding the web pouch being filled. The wheel 13 is smaller in diameter than the pouches 23.

I claim:

1. In a packaging machine for continuous forming of filled packages from relatively unstrechable roll stock of crinkled heat sealable filter paper, the improvement of a driven revolving drum attached to the machine, a series of pouch forming drum sockets provided in an outer surface of the drum, means for training roll stock filter paper onto said drum over said sockets, means for slitting the sheet of the filter paper along its length creating a pair of side-by-side heat sealable filter paper strips before the filter paper reaches the drum, a driven endless flexible belt operatively engaged with the outer drum surface, suction means for drawing overlapped belt areas of the belt into the drum sockets along with the relatively unstretchable crinkled filter paper strips sandwiched between the overlapped belt area and the pouch forming drum sockets thereby forming side-by-side continuous strips of crinkled paper pockets, means for filling the crinkled filter paper pockets with material to be packaged while on the drum, means for training and overlapping a second sheet of heat sealable paper over the filled filter paper sockets on the pair of side-by-side filter paper strips, means for sealing the overlapped heat sealable sheet of filter paper in sealed connection about the filled paper sockets on the pair of heat sealable filter paper strips to form sealed filled pouches, conveyor means for transporting sealed filled pouches after being severed from the lapped sealed strips of filter paper, and means for severing the filled pouches from the overlapped sealed strips and depositing the severed filled pouches upon the conveyor means.

2. The packaging machine of claim 1 further characterized by a product hopper overlying said drum, a series of bins underlying said hopper, a pair of driven conveyors mounted in side-by-side relation beneath a lowermost of the bins for receiving product there through, a pair of conveyors underlying a lowermost one of the bins for receiving separate supplies of product, said conveyors having variable speed drives to adjust the flow of product for filling said paper pouches, a control panel adjacent ground level for regulating the speed of the conveyors, said conveyors being positioned for supplying product to fill the paper pockets in the pair of side-by-side filter paper st ips, the means for filling the crinkled filter paper pouches with material including a product supply drum, product supply ducts for transporting product into the interior of said product supply drum for supplying product to fill the pouches in each of the side-by-side filter paper strips, and a wiper inside of said product supply drum, the product supply drum having circumferentially spaced discharged ports movable in timed relation relative to said drum pockets as said wiper causes product to move through said discharge ports into said paper pockets.

3. The machine according to claim 2 including said suction means being releasable after the crinkled filter paper pockets have been formed in said strips and with said flexible belt then being released from said drum sockets for enabling said pockets to then be filled by said means for filling.

4. The machine of claim 1 further defined by said suction means causing a width of said paper web to be contracted across said wheel pockets on opposite edges of the paper web as the paper web is drawn into said wheel pockets.

5. The machine of claim 1 further defined by paper crinkling means being mounted on the machine and engageable with the filter paper for crinkling the web of relatively non-stretchable paper before the web is trained onto said drum.

6. In a packaging machine for continuous forming of filled packages from relatively unstretchable roll stock of crinkled heat sealable filter paper, the improvement of a driven revolving drum attached to the machine, a series of pouch forming drum sockets provided in an outer surface of the drum, means for training roll stock filter paper onto said drum over said sockets, a driven endless flexible rubber-like belt operatively engaged with the outer drum surface, suction means for pulling overlapped belt areas of the belt into the drum sockets along with the relatively unstretchable crinkled filter paper strips sandwiched between the overlapped belt area and the pouch forming drum sockets thereby forming paper pockets along the length of the filter, said suction means being releaseable to allow the belt to elastically withdraw from the drum sockets on a successive basis after the paper pockets have been formed, means for filling the crinkled filter paper pockets with material to be packaged while on the drum, means for training and overlapping a second sheet of heat sealable paper over the filled filter paper sockets on the filter paper, means for sealing the overlapped heat sealable sheet of filter paper in sealed connection about the filled paper sockets on the pair of heat sealable filter paper strips to form sealed filled pouches, conveyor means for transporting sealed filled pouches after being severed from the lapped sealed strips of filter paper, and means for severing the filled pouches from the overlapped filter paper and depositing the severed filled pouches upon the conveyor means.

7. The machine of claim 6 further characterized by said means for filling comprising a circular filling wheel, product supply ducts being extended into the interior of said circular filling wheel from axially opposite sides thereof, discharge chutes in said product supply drum being circumferentially separated from one another by circumferentially spaced drum lands, the lands being positioned beneath discharge ends of said product supply ducts for receiving product, and scraper means for scraping the product causing the product to free fall through the chutes into underlying paper pockets during co-rotation therewith.

8. The machine of claim 6 further defined by said drum sockets having vent means for allowing suction to be drawn therethrough and yet for providing a solid support for the paper pouches to be pulled against when said suction means applies suction thereto drawing areas of the crinkled paper web and the rubber belt therein.

9. A method of forming product filled individual packages comprising the steps of moving a first continuous web of crinkle type heat sealable filter paper of a relatively nonstretchable type towards pouch forming areas, training the filter paper onto a revolving drum carrying the forming areas, comprising of circularly arranged drum sockets, training a revolving endless rubber belt over the pouch forming area, applying a releasable suction to the vented bottoms of the drum sockets drawing the crinkle type heat sealable filter paper and an engaged portion of the rubber belt into the underlying drum socket consecutively forming paper pouches in the web, releasing the suction and allowing the rubber belt to exit from the formed paper pouch, filling the pouches with product, causing a second length of paper of heat sealable filter paper to be placed against the first length of paper together, sealing together the second length of paper to the strips forming filled sealed pouch areas, and cutting out the sealed pouches from the sealed first and second lengths of filter paper to form individual product filled packages.

10. A method of forming product filled individual packages comprising the steps of moving a first continuous length of crinkle type heat sealable filter paper of a relatively nonstretchable type towards a forming area, simultaneously training a stretchable flexible rubber-like belt in contact with the filter paper with the filter paper being between the belt and the forming area, consecutively suction drawing spaced areas of both the filter paper and the rubber-like belt into pouch forming sockets forming side-by-side pouches from the crinkle type heat sealable filter paper spaced along the length of the paper, releasing the suction allowing the stretched areas of the belt to move out of the pockets, filling the pouches with product, causing a second length of paper of heat sealable paper to be superimposed against the first length of paper together, sealing the superimposed lengths of paper together forming filled sealed pouch areas, and cutting out the sealed pouches from the sealed first and second lengths of filter paper to form individual product filled packages.

11. The method of claim 10 further defined by causing product to fall through ports in a filling wheel where the ports are formed with a much smaller diameter than the diameter of the pouches to be filled whereby product can be caused to fall in a controlled manner into the pouch with a minimum of dusting of the product to a surrounding paper area so the sealing the length of paper can be effectively completed without interference from product spillage.

12. In a pouch forming apparatus for manufacturing a filled filter pack comprising, a hollow rotatingly driven drum having an annular rim flange, circumferentially spaced drum web forming pockets provided about then circumference of said annular rim flange, circumferentially spaced drum land areas separating the web forming pockets from one another, a roll of porous relatively non-stretchable crinkled filter paper providing a porous paper web trained on said drum, an endless driven rubber belt assembly mounted radially outwardly of said hollow drum, said belt assembly including a flexible rubber belt trained to confront at least two of said drum pockets with said rubber belt extended circumferentially over said rotatively driven pockets and lands on said drum, a suction head mounted internally of said drum having releaseable suction means co-acting with said lands and said pockets and operating to generate an initial suction force to suck confronting areas of said porous paper web and said flexible rubber belt into successive drum pockets, said suction means then being releaseable to allow said rubber belt to retreat from said pockets to create a succession of filter pockets in said porous paper web for filling with product.

13. The apparatus of claim 12 further defined by said suction means causing a width of said paper web to be contracted across said wheel pockets on opposite edges of the paper web as the paper web is drawn into said wheel pockets.

14. The apparatus of claim 12 further defined by paper crinkling means being mounted on said apparatus and engageable with said crinkled filter paper for crinkling said web of relatively non-stretchable paper before the web is trained onto said drum.

15. The machine of claim 6 further defined by said suction means being mounted interiorally of said revolving drum and fixedly mounted relative to said drum, said suction means being periodically engageable with said sockets for forming web pockets.

16. The machine of claim 6 further defined by said suction means being mounted interiorally of said revolving drum and fixedly mounted relative to said drum, said suction means being periodically engageable with said drum sockets, each of said drum sockets having a structurally solid but air pervious bottom for supporting web paper as the suction means is activated to pull the web paper and said overlapped belt areas into said sockets and with the suction being pulled through the structurally solid air previous bottoms of the sockets against the belt areas to form paper pouches.

17. The machine of claim 6 further defined by said suction means being mounted interiorally of said revolving drum and fixedly mounted relative to said drum approximately at a 2 o'clock to 3 o'clock position on the drum, said suction means being periodically engageable with said sockets for forming web pockets.

18. The apparatus of claim 6 further defined by said suction means being fixedly mounted relative to said drum, said suction means being periodically engageable with said drum pockets, each of said drum pockets having a structurally solid but air pervious bottom for supporting web paper as the suction means is activated to pull the web paper and said overlapped belt areas into said pockets and with the suction being pulled through the structurally solid air pervious bottoms of the sockets against the belt areas to form paper pouches.

19. The machine of claim 6 further defined by said means for training and overlapping a second sheet of heat sealable paper over filled paper sockets doing so before the sockets are rotated sufficiently to tip and to dislodge the material from the filled sockets and at an approximate 11 o'clock position on said revolving drum.

20. A method of forming product filled individual pouches comprising the steps of moving a first continuous web of crinkle type heat sealable filter paper of a relatively nonstretchable type towards a paper pouch forming area, engaging a stretchable flexible rubber-like belt against the first web of the filter paper with the filter paper being positioned between the belt and the paper pouch forming area, consecutively suction drawing spaced areas of both the filter paper and the rubber-like belt into pouch forming sockets forming side of pouches from the crinkle type heat sealable filter paper spaced along the length of the paper while reducing the width of the web on opposite sides of each pouch, releasing the suction allowing the stretched areas of the belt to move out of the pockets, filling the pouches with product, causing a second length of paper of heat sealable paper to be superimposed against the first length of paper together, heating the second length of paper and rolling it against the first web while leaving the product and the first web relatively unheated sealing the superimposed lengths of paper together forming filled sealed pouch areas, and cutting out the sealed filled pouches from the sealed together first and second lengths of filter paper to form individual product filled pouches.

* * * * *